United States Patent [19]

Fushimoto

[11] Patent Number: 4,787,567

[45] Date of Patent: Nov. 29, 1988

[54] APPARATUS FOR HOLDING RECORDING MEDIUM

[75] Inventor: Hideo Fushimoto, Tokyo, Japan

[73] Assignee: Canon Kabushiki Kaisha, Tokyo, Japan

[21] Appl. No.: 97,282

[22] Filed: Sep. 10, 1987

Related U.S. Application Data

[63] Continuation of Ser. No. 852,718, Apr. 16, 1986, abandoned.

[30] Foreign Application Priority Data

Apr. 24, 1985 [JP] Japan ..... 60-86523
Dec. 27, 1985 [JP] Japan ..... 60-292972

[51] Int. Cl.[4] ..... B41J 15/04

[52] U.S. Cl. ..... 242/55.2; 235/58 CF; 235/58 P; 400/613

[58] Field of Search ..... 242/55, 55.2, 67.3 R; 235/58 CF, 58 P, 60 P, 2; 400/613

[56] References Cited

U.S. PATENT DOCUMENTS

| | | | |
|---|---|---|---|
| 1,567,499 | 12/1925 | Grandjean | 400/613 |
| 2,107,020 | 2/1938 | Williams | 242/55.2 |
| 2,626,109 | 1/1953 | Hart | 242/55.2 |
| 3,033,339 | 5/1962 | Simms | 400/613 |
| 4,277,034 | 7/1981 | Buzzell | 242/67.3 R |

FOREIGN PATENT DOCUMENTS

| | | | |
|---|---|---|---|
| 1082085 | 12/1954 | France | 400/613 |
| 90388 | 7/1980 | Japan | 400/613 |
| 101484 | 8/1980 | Japan | 400/613 |
| 33973 | 4/1981 | Japan | 400/613 |
| 60284 | 5/1981 | Japan | 400/613 |
| 12035 | 1/1984 | Japan | 242/55.2 |

*Primary Examiner*—Stanley N. Gilreath
*Assistant Examiner*—Joseph J. Hail, III
*Attorney, Agent, or Firm*—Fitzpatrick, Cella, Harper & Scinto

[57] ABSTRACT

The invention relates to a recording medium holding apparatus to stably fix a recording medium onto which the recording is performed by a recording member by a holding member when the recording medium is used. When the recording medium is not used, the holding member is enclosed into the bottom surface of the main body so as to prevent the holding member from projecting out of the main body and becoming an obstacle. Further, the enclosed holding member is stably fixed to prevent the damage of the apparatus main body due to the vibration or the like.

14 Claims, 3 Drawing Sheets

APPARATUS FOR HOLDING RECORDING MEDIUM

This application is a continuation of application Ser. No. 852,718, filed Apr. 16, 1986, now abandoned.

BACKGROUND OF THE INVENTION

1. Field of the Invention

The present invention relates to an apparatus having a holding member to hold a recording medium and, more particularly, to a recording medium holding apparatus which allows the holding member to be movable in accordance with whether the recording medium is used or not.

2. Related Background Art

A recording medium wound like a roll (hereinafter, simply referred to as a roll paper) is used in electronic equipment having a recording apparatus, for example, in an electronic portable computer equipped with a printer or the like.

As a particular example of the use of roll paper, the paper is detachably set to a holder which is rotatably provided on the side of the electronic equipment and used.

FIG. 1 illustrates an example of an electronic equipment equipped with such a kind of conventional holder.

In FIG. 1, an electronic equipment 1 has an upper casing 1*a* and a lower casing 1*b*.

The edge portion of the upper casing 1*a* is provided with a bearing portion 7 arranged horizontally. A holder 6 is rotatably axially supported by the bearing portion 7.

Namely, the holder 6 is formed by bending, for example, a steel rod having a circular cross section or the like so as to become substantially the U shape. One arm 6*a* of the holder 6 is rotatably inserted into the bearing portion 7. The other arm 6*b*, which is parallel with the arm 6*a*, serves as a bearing portion of the roll paper.

The holder 6 can rotate in the direction indicated by an arrow A in the diagram around the arm 6*a* as a rotational center. When roll paper (not shown) is not used, the holder 6 is rotated and mounted onto the upper casing 1*a* as shown by a solid line in FIG. 1. When the roll paper is used, the holder 6 is rotated around the arm 6*a* until the base portion of the holder 6 comes into contact with a stopper 8 provided for the lower casing 1*b*. In this state, the arm 6*b* as the bearing portion is inserted into the core of the roll paper and thereby to set the roll paper.

The edge portion of the roll paper set in this manner is inserted from an insertion port 9 formed in the lower casing 1*b* at a position under the bearing portion 7. Recording is then performed onto the roll paper from the edge portion by recording means (not shown). After completion of the recording, the roll paper is pulled out of an opening portion 11 of a cover 10 provided for the upper casing 1*a* so that the cover 10 can be freely opened or closed. When the edge portion of the roll paper is stretched, the roll paper is cut out by a cutter 12 provided for the cover 10 at the position where the roll paper is in contact with the cutter 12.

However, with the foregoing structure, in the case where the roll paper is not used, the holder 6 is rotated and mounted onto the upper casing 1*a*, so that the user feels as if an alien substance existed on the upper casing, resulting in the loss of united external appearance of the electronic equipment. In addition, since the arm of the holder comes into contact with the upper surface of the upper casing, there is a fear that the arm 6*b* will collide with the upper surface of the upper casing and cause the upper surface to be damaged or the like de to the vibration when the user carries the apparatus or due to carelessness such that the user erroneously releases his hold of the arm 6*b* from a high position, or the like. On the other hand, when the roll paper is used, the holder is restricted by the stopper in the downward direction. However, no restricting means is provided in the upward direction, so that it is difficult to support the holder. For example, in the case where the apparatus main body is carried upon loading of the roll paper or where the apparatus is used with the main body held in the hand, or the like, there are the problems that the roll paper is not stably supported and that it is difficult to smoothly feed the roll paper.

SUMMARY OF THE INVENTION

The first object of the present invention is to move the position of the member for holding a recording medium in accordance with whether the recording medium is used or not and to reduce an amount of projection of the holding member when the recording medium is not used, thereby reducing the external size of the apparatus.

The second object of the invention is to stably fix the holding member at the respective positions in a state (when the recording medium is used) in which the holding member is projected from the apparatus main body and in a state (when the recording medium is not used) in which the holding member is enclosed in the apparatus main body.

The third object of the invention is to prevent the apparatus main body from being broken due to the collision of the holding member which is caused due to the vibration of the apparatus or the like.

BRIEF DESCRIPTION OF THE DRAWINGS

FIGS. 2 to 8 are diagrams for explaining an embodiment of the present invention, in which FIG. 2 is a schematic perspective view of an electronic equipment to which an apparatus of the present invention is attached;

FIG. 3 is a perspective view of the main part of a holding apparatus;

FIG. 4 is a cross sectional view taken along the line IV—IV in FIG. 3;

FIG. 5 is a cross sectional view taken along the line V—V in FIG. 3;

FIG. 6 is a perspective view of the main part of the back surface of the holding apparatus;

FIG. 7 is a cross sectional view taken along the line VII—VII in FIG. 6; and FIG. 8 is a cross sectional view taken along the line VIII—VIII in FIG. 6.

DETAILED DESCRIPTION OF THE PREFERRED EMBODIMENTS

Figure 1:
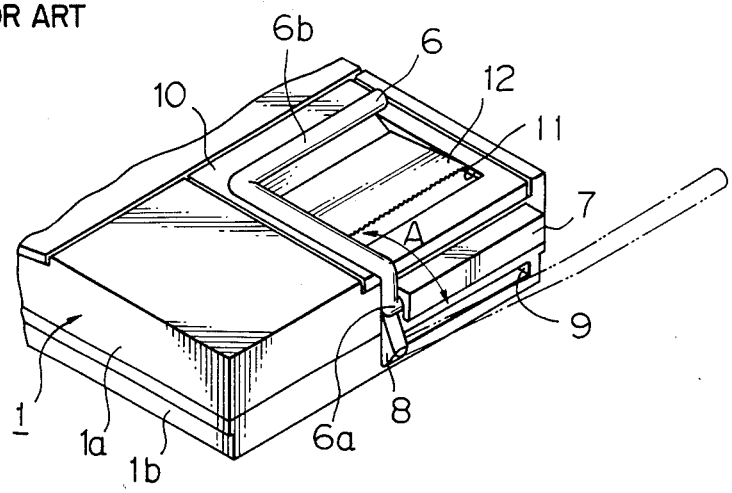
Fig. 1 PRIOR ART
FIG. 1 is a perspective view showing a conventional example.

To solve the conventional problems, the present invention adopts the structure in which an enclosing portion of a holder having a bearing portion for a roll paper is provided on the side of the back surface of a lower casing of electronic equipment, and an engagement portion for restricting the upward movement of the holder and an engaging member which restricts the downward movement of the holder and can be operated from the outside are provided on the side of the casing.

With the above structure, when the roll paper is not used, the holder can be enclosed into the enclosing portion formed on the side of the back surface of the electronic equipment. When the roll paper is used, the holder is pulled out of the enclosing portion so that it can be used. The upper side of the base portion of the holder is supported by the engaging portion on the side of the casing, while the lower side of the base portion is sandwiched by the engaging member which is provided so that it can be operated from the outside, thereby enabling the holder to be stably held in the operative mode.

The invention will be described in detail hereinbelow on the basis of an embodiment shown in the drawings.

FIGS. 2 to 8 are diagrams for explaining one embodiment of the invention. In the diagrams, the same or corresponding parts and components as those shown in FIG. 1 are designated by the same reference numerals and their descriptions are omitted.

Figure 2:
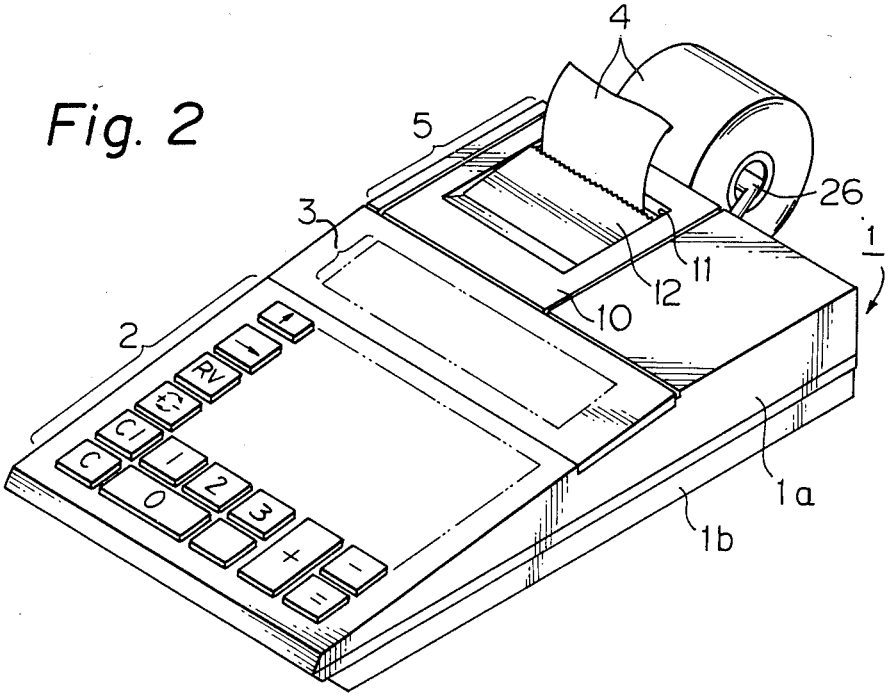

FIG. 2 shows an external appearance of a portable electronic computer equipped with a printer as an example of electronic equipment to which the invention is applied.

Namely, a keyboard unit 2 to input numerical values or content of the calculation is provided on the upper surface of the front half part of the upper casing 1*a* of the electronic equipment 1. A display unit 3 to display the input data or result of the calculation is provided on the upper surface at the center of the upper casing 1*a*. A recording unit 5 to record the input data or result of the calculation onto a roll paper 4 is provided in the back half part.

A battery to drive an operating circuit and the printer and the like are enclosed in the electronic equipment 1.

Figure 6:
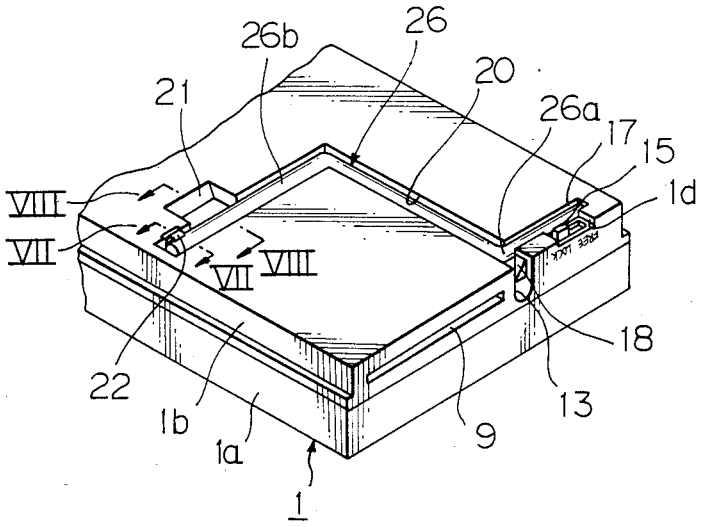

As shown in FIG. 6, on the other hand, an enclosing portion 20 formed so as to have a substantially L shape and having a U-shaped cross section is provided on the side of the back surface of the lower casing 1*b*.

A holder 26 is enclosed in the enclosing portion 20.

In the embodiment, the holder 26 is formed so as to have a substantially Z shape and formed by bending, for example, a steel rod having a circular cross section or the like. The holder 26 has a bent portion 26*a* at its base end and a bearing portion 26*b* of the roll paper on the side of the other end. The bearing portion 26*b* is formed by being bent in the direction opposite to the bent portion 26*a*. The bent portion of the base portion of the holder 26 is inserted into a groove 17 formed in the back surface of the lower casing 1*b*.

Figure 5:
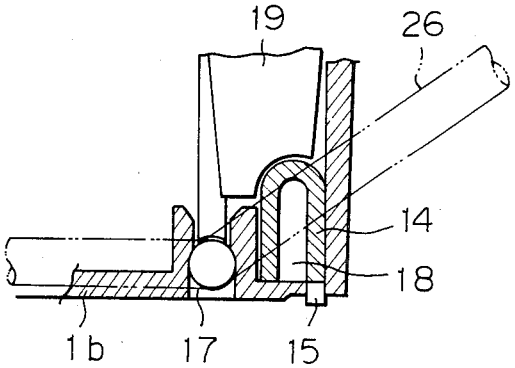

As shown in FIG. 5, the innermost side of the groove 17 constitutes an arc-like bearing portion 17*a* whose diameter is almost equal to that of the holder 26. The entrance side of the groove 17 is slightly smaller than the diameter of the holder 26.

Therefore, by pressing and inserting the bent portion 26*a* into the bearing portion 17*a* from the entrance side of the groove 17, the holder 26 can be freely rotated in this portion.

As shown in FIG. 5, a guide member 19 is extended downwardly from the side of the upper casing 1*a* and a part of this guide member is located on the bearing portion 17*a*, thereby restricting the upward movement of the bent portion 26*a*.

Figure 7:
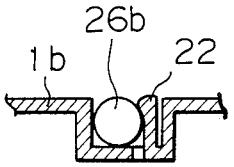
Figure 8:
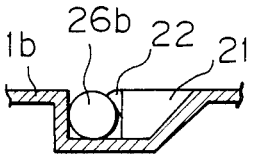

A concave portion 21 adapted to allow a finger to hook holder 26 is formed in the back surface of the lower casing 1*b* on the side of the free end of the bearing portion 26*b* of the roll paper of the holder 26 as shown in FIGS. 6 and 8. A hook 22 is extended from the side of the lower casing 1*b* near the edge portion of the bearing portion 26*b* as shown in FIG. 7, thereby making it possible to temporarily fix the edge of the bearing portion 26*b* of the holder 26.

When it is desired to take out the holder 26 from the enclosing portion 20, a finger is inserted into the concave portion 21 to hook the holder 26 and the hook 22 is elastically deformed and pulled out. By doing this, the holder 26 rotates around the bent portion 26*a* as a rotational center and can be popped up from the enclosing portion 20.

On the other hand, the end portion on the edge side of an lower casing 1*b* of the enclosing portion 20 constitutes a U-shaped engagement portion 13 having the inclined bottom surface. An angle of inclination of the bottom surface of the engagement portion 13 is set to an angle of projection of the holder when the holder is used.

Further, an engaging member 14 which can be operated from the outside is provided on the side of the lower casing 1*b* such that its edge portion faces the engagement portion 13.

Namely, as shown in FIG. 5, the engaging member 14 is formed so as to have a U-shaped cross section and slidably guided by the side wall of the lower casing 1*b* and guide member 19 and the like. A spring 16 is elastically attached between a projection 14*a* projectingly formed at one end of the engaging member 14 and a projection 1*c* formed to face the side of the lower casing 1*b*. The engaging member 14 is pressed to the right in FIG. 4 by the spring 16.

A knob 15 is also projectingly formed as a part of the engaging member 14 so as to face in the outward direction from an opening portion 1*d* formed on the back surface of the lower casing 1*b*. The knob 15 can be operated from the outside.

A projection 18 is also projectingly formed on the side opposite to the projection 14*a* of the engaging member 14.

The projection 18 is formed so as to become an almost triangular pyramid and its edge faces the space in the edge portion of the enclosing portion 20 which forms the engagement portion 13.

A lower surface 18*b* of the projection 18 has an angle of inclination of only a predetermined angle of $\alpha$ and its upper surface 18*a* is also tapered at only a predetermined angle of $\beta$ which is fairly smaller than the angle $\alpha$.

The method of using the embodiment with such a constitution as mentioned above and its operation will now be described.

When the roll paper is not used, the holder 26 is inserted into the enclosing portion 20 formed on the back surface side of the lower casing 1*b* as shown in FIG. 6. The edge of the bearing portion 26*b* of the roll paper is retained by the hook 22, so that the holder 26 does not protrude from the back surface of the lower casing 1*b*.

Consequently, the holder 26 cannot be seen from the upper surface side of the electronic equipment and the united external appearance of the electronic equipment is not lost.

On the contrary, when the user wants to use the roll paper, a finger is inserted into the concave portion 21 adapted to hook the finger and the bearing portion 26*b* is hooked by the finger to release the engagement with the hook 22. Then, a force is applied such that the bearing 26*b* is removed from the back surface of the lower casing 1*b*. Due to this, the holder 26 is rotated around the bent portion 26*a* as a rotational center.

When the base portion of the holder 26 approaches the projection 18 of the engaging member 14, it is first come into contact with the inclined surface 18*b* formed on the lower surface of the projection 18. At this time, since the angle of inclination of the inclined surface 18*b* is fairly large, the divided force in the horizontal direction is caused due to the depression by the holder 26. Thus, the engaging member 14 is immediately moved to the left in FIG. 4 against the elastic force of the spring 16 and the base portion of the holder 26 is moved to the side of the U-shaped engagement portion 13.

Figure 4:
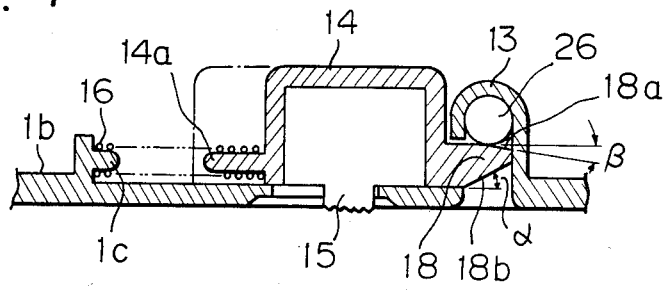

When the base portion of the holder 26 is completely moved to the side of the engagement portion 13, the engaging member 14 moves to the right in FIG. 4 due to the elastic force of the spring 16, thereby causing the base portion of the holder 26 to be retained by the upper portion of the projection 18.

Figure 3:
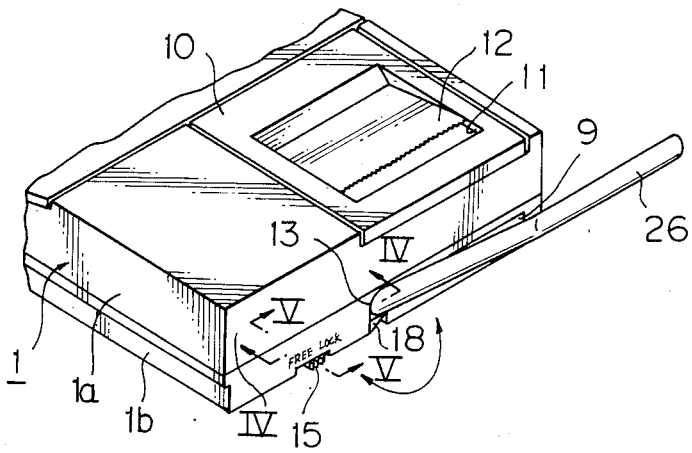

In this state, the base portion of the holder 26 upwardly projects as shown in FIG. 3 in the state in accordance with the angle of inclination of the oblique surface which is formed by the bottom surface of the engagement portion 13. Also, the upper side of the holder 26 is pressed by the engagement portion 13 and the lower side is pressed by the projection 18, so that the operative state can be easily maintained. The roll paper (not shown) which is set to the bearing portion 26*b* can be stably held and the roll paper can be certainly fed.

In this operative state, if an excessive external force is applied to the holder 26, the tapered surface of the angle $\beta$ of inclination formed on the upper surface of the projection 18 is pressed by the holder 26, so that the horizontal divided force is caused in a manner similar to the above. Thus, the engaging member 14 is forcedly moved to the left in FIG. 4 and the holder 26 is pulled out of the engagement portion 13. Therefore, the projection 18 will not be damaged or the like.

To close the holder 26, on one hand, the knob 15 is hooked with the finger and moved to the left in FIG. 4 against the elastic force of the spring 16 and the projection 18 is removed from the engagement portion 13. Thus, the holder 26 can be freely rotated and can be easily enclosed into the enclosing portion 20 as shown in FIG. 6.

In the foregoing embodiment, the Z-shaped bent holder 26 has been shown. However, the holder 26 may be bent like a U shape or other shape. The material of the holder 26 is not limited to iron but may be a synthetic resin or the like.

As will be obvious from the above description, according to the present invention, there is adopted the structure in which the enclosing portion of the holder is provided on the back surface side of the casing of the electronic equipment, and when the holder is used, the engagement portion to press the base portion of the holder from the upper side and the engaging member which presses the base portion of the holder from the lower side and can be operated from the outside are provided. Therefore, even when the holder is not used, the united external appearance is not lost. When the holder is used, the operative state of the holder is assured. Therefore, the roll paper is stably held and can be certainly fed.

What is claimed is:

1. An apparatus for holding a recording medium, comprising:

a casing equipped with a recording member to record onto a recording medium;

holding means having a rotary member for rotatably supporting said holding means to said casing and a holding portion for holding said recording medium; and restricting means provided for said casing, for restricting said holding portion of said holding means at a position away from the casing when said holding portion holds said recording medium, and for positioning said holding portion within a concave enclosing portion disposed in a bottom surface of said casing when said holding portion does not hold said recording medium;

wherein when said holding portion does not hold said recording medium, said holding portion is rotated by more than 180 degrees from the position away from the casing where said restricting means restricts said holding portion when said holding portion holds said recording medium, and said holding portion is positioned within said concave enclosing portion.

2. An apparatus according to claim 1, wherein said restricting means acts on a coupling portion between said rotary member and said holding portion of said holding means.

3. An apparatus according to claim 2, wherein said holding portion of said holding means is restricted at a position higher than the back surface of said casing.

4. An apparatus according to claim 1, wherein said holding portion of said holding means is restricted at a position higher than the back surface of said casing.

5. An apparatus according to claim 1, wherein said rotary member is rotatable by at least 180°.

6. An apparatus for holding a recording medium, comprising:

a casing equipped with a recording member for recording onto a recording medium;

holding means having a rotary member for rotatably supporting said holding means to said casing and a holding portion for holding said recording medium; and restricting means provided for said casing, for restricting said holding portion of said holding means at a position away from the casing when said holding portion holds said recording medium, and for restricting said holding portion within a concave enclosing portion disposed in a bottom surface of said casing when said holding portion does not hold said recording medium;

wherein when said holding portion does not hold said recording medium, said holding portion is rotated by more than 180 degrees from position away from the casing where said restricting means restricts said holding portion when said holding portion holds said recording medium, and said holding portion is restricted within said concave enclosing portion.

7. An apparatus according to claim 6 wherein said restricting means retains said holding portion of said holding means to said casing.

8. An apparatus according to claim 6, wherein said rotary member is rotatable by at least 180°.

9. An apparatus for holding a recording medium, comprising:

a casing equipped with a recording member for recording onto a recording medium;

holding means having a rotary member for rotatably supporting said holding means to said casing and a holding portion for holding said recording medium;

first restricting means provided for said casing, for restricting said holding means at a position where said holding portion of said holding means is away from said casing when said holding portion holds said recording medium; and second restricting means provided for said casing, for fixing said holding portion at a concave enclosing portion disposed in a bottom surface of said casing when said holding portion does not hold said recording medium;

wherein when said holding portion does not hold said recording medium, said holding portion is rotated by more than 180 degrees from the position where said first restricting means restricts said holding portion when said holding portion holds said recording medium, and said holding portion is restricted at said concave enclosing portion by said second restricting means.

10. An apparatus according to claim 9, wherein said first restricting means acts on a coupling portion between said rotary member and said holding portion of said holding means.

11. An apparatus according to claim 10, wherein said holding portion of said holding means is restricted at a position higher than the back surface of said casing.

12. An apparatus according to claim 9, wherein said holding portion of said holding means is restricted at a position higher than the back surface of said casing.

13. An apparatus according to claim 9, wherein said holding portion of said holding means is restricted at a position higher than the back surface of said casing.

14. An apparatus according to claim 9, wherein said rotary member is rotatable by at least 180°.

* * * * *

UNITED STATES PATENT AND TRADEMARK OFFICE

CERTIFICATE OF CORRECTION

PATENT NO. : 4,787,567

DATED : November 29, 1988

INVENTOR(S) : HIDEO FUSHIMOTO

It is certified that error appears in the above-identified patent and that said Letters Patent is hereby corrected as shown below:

COLUMN 2

Line 4, "de" should read --due--.

COLUMN 4

Line 15, "an" should read --the--.
Line 16, "the" should read --an--.

COLUMN 5

Line 6, "is" should be deleted.
Line 7, "come" should read --comes--.

COLUMN 6

Line 56, "position" should read --the position--.

UNITED STATES PATENT AND TRADEMARK OFFICE

CERTIFICATE OF CORRECTION

PATENT NO. : 4,787,567

DATED : November 29, 1988

INVENTOR(S) : HIDEO FUSHIMOTO

It is certified that error appears in the above-identified patent and that said Letters Patent is hereby corrected as shown below:

COLUMN 7

Line 13, "fixing" should read --restricting--.

Signed and Sealed this

Ninth Day of January, 1990

*Attest:*

JEFFREY M. SAMUELS

*Attesting Officer*

*Acting Commissioner of Patents and Trademarks*